US006590169B2

(12) United States Patent
Martinez

(10) Patent No.: US 6,590,169 B2
(45) Date of Patent: Jul. 8, 2003

(54) SWITCH ASSEMBLY FOR A POWER ACCESSORY

(76) Inventor: Richard J. Martinez, 1633 Lowe Dr., Algonquin, IL (US) 60102

( * ) Notice: Subject to any disclaimer, the term of this patent is extended or adjusted under 35 U.S.C. 154(b) by 0 days.

(21) Appl. No.: 10/047,803

(22) Filed: Oct. 22, 2001

(65) Prior Publication Data

US 2003/0075423 A1 Apr. 24, 2003

(51) Int. Cl.[7] ..... H01H 19/00

(52) U.S. Cl. ..... 200/17 R; 200/11 R; 200/573; 200/336; 200/568; 200/564

(58) Field of Search ..... 200/4, 5 R, 11 R, 200/11 A, 11 D, 11 DA, 17 R, 18, 61.27, 61.54, 564, 567, 568, 573, 574, 293, 295, 336

(56) References Cited

U.S. PATENT DOCUMENTS

| | | | | | |
|---|---|---|---|---|---|
| 4,652,947 | A | * | 3/1987 | Oka et al. | 200/11 G |
| 5,710,400 | A | * | 1/1998 | Lorenz et al. | 200/600 |
| 5,794,766 | A | * | 8/1998 | Morita et al. | 200/568 |
| 6,080,945 | A | * | 6/2000 | Mihara | 200/564 |
| 6,100,480 | A | * | 8/2000 | Takahashi | 200/11 R |

* cited by examiner

*Primary Examiner*—Michael Friedhofer
(74) *Attorney, Agent, or Firm*—Mathew R. P. Perrone, Jr.

(57) ABSTRACT

An electronic switch assembly, has at least one switch thereon, the at least one switch being capable of receiving a contact from a rotating cam, in order to control the power accessory.

19 Claims, 5 Drawing Sheets

SWITCH ASSEMBLY FOR A POWER ACCESSORY

This invention relates to an electronic switch and more particularly to an electronic switch assembly, suitable for use with a power accessory especially with a moving body in a vehicle, such as a vehicle door used in a power window device, a sunroof device, a power lock device and the like.

BACKGROUND OF THE INVENTION

Common to a modern vehicle, is a switch device, wherein the switch is positioned between or connected to a motor and a number of different items. These items include, but are not limited to, a door lock, a power window, a sun roof, and a vehicle alarm.

Power-assisted windows are available on vehicles of this time. The structure providing a power window involves an electronic switch operated by a conveniently mounted button. The button serves to activate an electric motor in order to raise or lower the window as desired.

A type of controller for any item, including a power window regulator provided in a door of a vehicle on the driver's side, has a manual mode switch and an automatic mode switch provided as a means for operating the controller. Ordinarily, this type of controller has a construction described below.

A relay is provided to control the energization of the motor for moving the window glass upward or downward. When the manual mode switch is turned on, the relay is operated to form a circuit for the energization of the motor. The window glass is moved upward or downward only for the period of time that the manual mode switch is in the "ON" state, thereby enabling the window glass to be moved to the desired position.

A retention circuit is provided which maintains the operating state of the relay (that is forming the motor energization circuit), once the relay is operated, by turning on the automatic mode switch. This occurs even after the automatic mode switch has been turned off.

An auto-stop circuit is also provided which detects a locked-rotor current which flows through the motor during the energization of the motor based on the maintained state of the relay. When the locked-rotor current is detected, the auto-stop circuit cancels the maintenance of the operating state of the relay that is affected by the retention circuit. Consequently, once the automatic mode switch is turned on, even for a short time, the operating state of the relay is maintained by the retention circuit even after the automatic mode switch has been turned off, thereby continuing the energization of the motor and, hence, the (upward or downward) movement of the window glass.

When the window glass that is moved in this way reaches a limited position (at which it completely closes or opens the window), a locked-rotor current flows through the motor. The auto-stop circuit detects this locked-rotor current and cancels the operation of the relay, thereby automatically stopping the energization of the motor in response to the window glass reaching the limited position.

However, once the locked-rotor current starts flowing through the motor, it decreases as the temperature of the motor winding increases. In some cases, the locked-rotor current becomes lower than a threshold level for detection of the locked-rotor current in the auto-stop circuit. In such an event, the operation maintained by the retention circuit is not cancelled and the energization of the motor continues uncontrollably. Such uncontrolled action results in the risk of the motor abnormally heating as well as the risk of an increase in the rate at which the vehicle battery; serving as the power source of the power window, is consumed.

Durability is a key feature of the power accessories of a vehicle. The window operation is used as an example. In particular, a major problem occurs whenever the power window does not operate. If the power window becomes stuck in a down position, rain can enter the vehicle. Having the interior of a vehicle become wet, is clearly undesirable. If the power window becomes stuck in an up position, safety of a person in the vehicle can be compromised, especially if the door of the vehicle becomes inoperable for any reason.

The manufacturing process for such a reliable switch can be difficult. Clearly, if a switch can be more easily manufactured, while maintaining the same reliability or better reliability, great advantages can be obtained. Accordingly, an improved switch for a power accessory on a vehicle is extremely desirable.

SUMMARY OF THE INVENTION.

Among the many objectives of this invention is to provide an improved switch assembly for a power accessory on a vehicle.

Another objective of this invention is to provide an improved switch assembly for a power window on a vehicle.

Yet another objective of this invention is to provide an improved switch assembly for a power sunroof on a vehicle.

Still, another objective of this invention is to provide an improved switch assembly for a power lock on a vehicle.

Additionally, an objective of this invention is to provide an improved switch assembly for a key operated accessory on a vehicle.

Also, an objective of this invention is to provide a durable switch assembly for a power accessory on a vehicle.

A further objective of this invention is to provide an easily manufactured switch assembly for a power accessory on a vehicle.

These and other objectives of the invention (which other objectives become clear by consideration of the specification, claims and drawings as a whole) an electronic switch assembly, with at least one switch thereon, the at least one switch being capable of receiving a contact from a rotating cam, in order to control the power accessory.

BRIEF DESCRIPTION OF DRAWINGS

Throughout the figures of the drawings, where the same part appears in more than one figure, the same number is applied thereto.

DESCRIPTION OF THE PREFERRED EMBODIMENTS

With the electronic switch assembly, almost any power accessory on a vehicle can be operated. A housing for the electronic switch assembly contains the elements thereof. The housing includes a body as a lower portion and a cover as a top portion. Resting on the body is the circuit board. An activating rotor is placed over the circuit board. The cover holds the rotor and circuit board on the body and within the housing.

For the housing, the interior must provide for the generally reciprocal and circular movement of the activating rotor in order to contact a switch, when such contact is desired. However, the exterior of the housing may be of any suitable shape. Typical shapes are generally defined as cylindrical, rectangular or other appropriate shape. Usually, the desired shape has a generally cylindrical appearance.

The electronic switch assembly, in general, and the switch mechanism, in particular, may be connected in a circuit in any suitable fashion. Solid, rigid, semi-rigid or flexible connectors from the switch mechanism may be used. Wires, prongs, other connectors, and combinations thereof may be used as connectors. With the connectors, any suitable standard electrical fastener may be used. Solder, tape, clips or other fasteners are usable fasteners, either singly or in combination.

Extending from the body is a lower connector cradle adapted to protect the connecting prongs or wires, which extend from the circuit board. Likewise extending from the cover is an upper connector cradle adapted to protect the connecting prongs, which extend from the circuit board. Clearly, the upper connector cradle combines with the upper connector cradle to surround and protect the connecting prongs or wires.

In cooperation with the housing, a plug shield protects the prongs. The plug shield snaps onto the body. It also serves as a guide for connecting the switch assembly as desired. Also on the plug shield is a locking latch, which serves to further support the switch assembly.

Within the switch assembly, one or two activating switches are desired, with the final number depending on the circuit, in which, the switch assembly is used. Such a structure has at least one tactile switch. Such a tactile switch is easily and commercially available.

Figure 1:
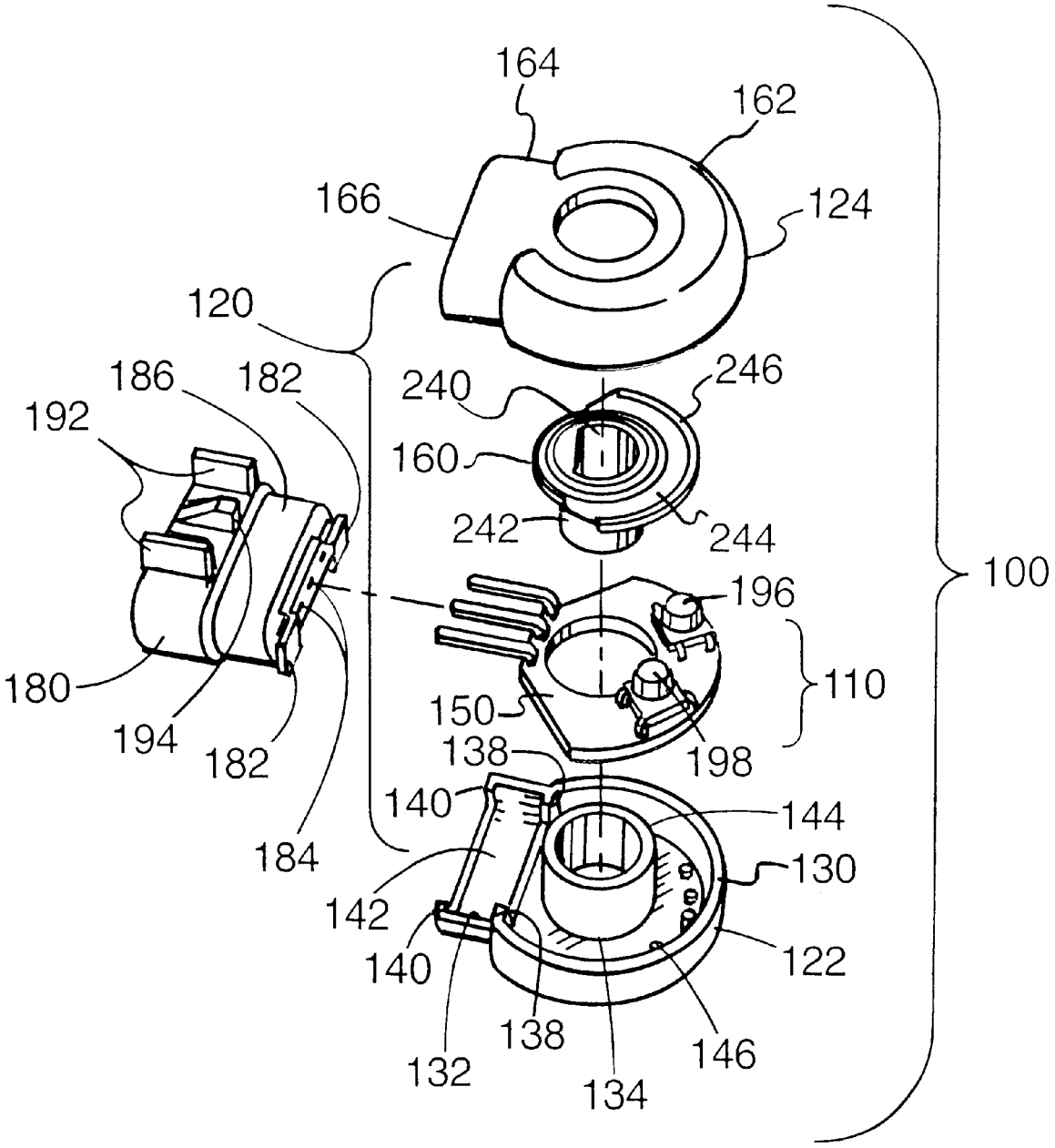
FIG. 1 depicts an exploded perspective view of the circular electronic switch assembly 100 of this invention.
Figure 8:
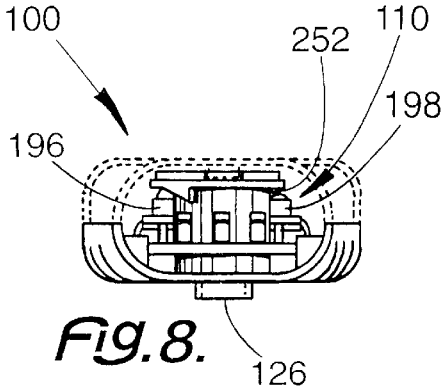
FIG. 8 depicts a front side, profile view of the circular electronic switch assembly 100 with right switch 198 of switch mechanism 110 depressed.
Figure 9:
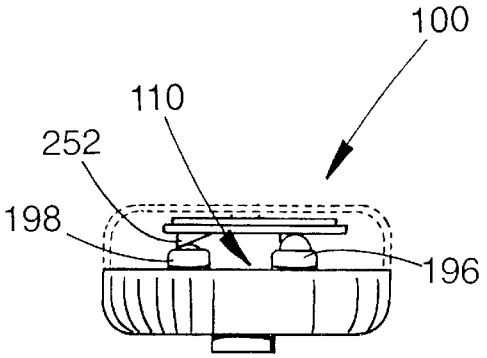
FIG. 9 depicts a back, side view of the circular electronic switch assembly 100 of this invention, based on FIG. 8.
Figure 10:
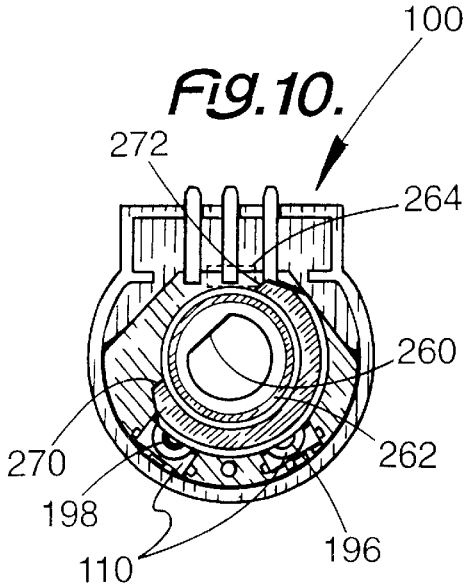
FIG. 10 depicts a top plan view of the circular electronic switch assembly 100 with right switch 198 of switch mechanism 110 depressed, based on FIG. 8.
Figure 11:
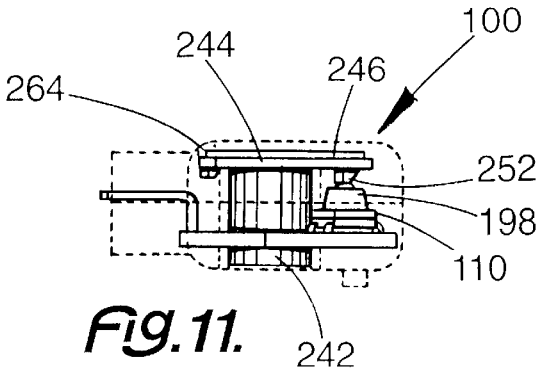
FIG. 11 depicts a right side, profile view of the circular electronic switch assembly 100 with right switch 196 of switch mechanism 110 depressed.

Referring now to FIG. 1, circular electronic switch assembly 100 has a housing 120, which in turn, has a body 122 and a cover 124 for the body 122. Attached to or contained within housing 120 are the elements of the electronic switch assembly 100. At the base of body 122 is a body mount 126 (FIG. 8).

Housing 120 has a generally circular appearance, with a protrusion extending therefrom. More particularly, body 122 as a circular member 130 with a cradle 132 extending therefrom. At the base of circular member 130 is the circuit receiver 134. Adjacent to the cradle 132 on either side thereof are holding lips 138. Cradle 132 extends with wings 140 and cradle base 142. Centrally located in circular member 130 is cylinder mount 144. On circuit receiver 134 is a series of board mounting pins 146. Switch mechanism 110 rests on mounting pins 146 in body 122.

Over the cylinder mount 144 is fitted switch mechanism 110. Over the switch mechanism 110 and into cylinder mount 144 is fitted activating rotor 160. Over activating rotor 160 is fitted cover 124. Cover 124 is similar in shape to body 122.

Thus, cover 124 has a circle cover portion 162 with a cover protrusion 164 extending therefrom. Cradle 132 and cover protrusion 164 cooperate to form a connector tunnel 166, through which, the plug shield 180 may be received.

On the plug shield 180 are wing grips 182 which are adapted to cooperate with holding lips 138 on the body 122 and secure the plug shield 180 within housing 120, in a snap fit fashion.

Plug shield 180 includes prong apertures 184 positioned adjacent to wing grips 182. Adjacent to prong apertures 184 is slide member 186, which fits into connector tunnel 166. Slide member 186 expands slightly to receive plug shield 180. If desired, gripping wings 192 and locking latch 194 may be present on plug shield 180 for the purpose of securing circular electronic switch assembly 100 at a desired position.

Figure 2:
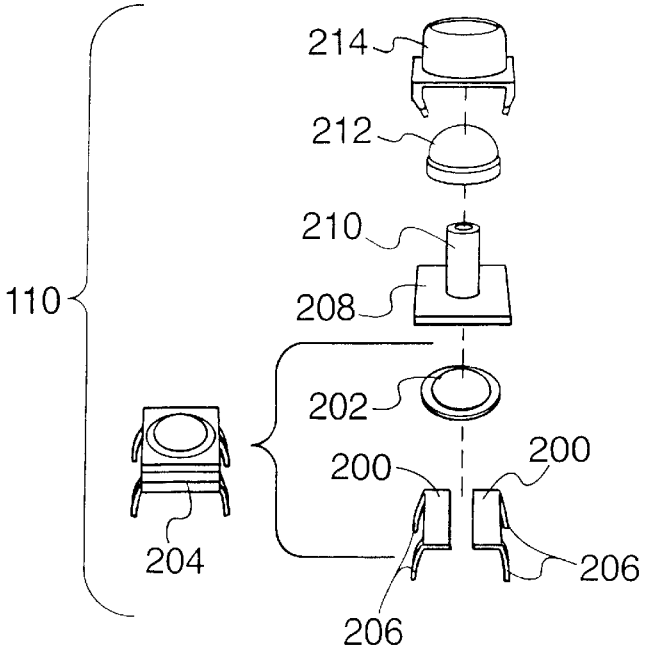
FIG. 2 depicts an exploded perspective view of the switch mechanism 110 for the electronic switch assembly 100 of this invention.
Figure 3:
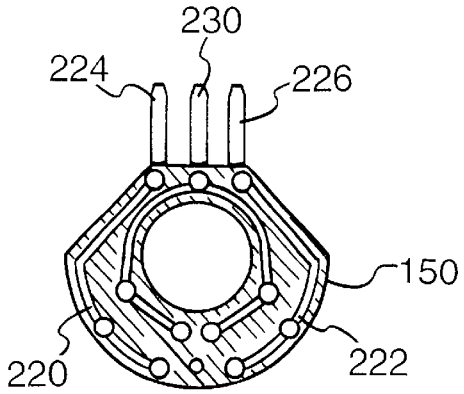
FIG. 3 depicts a bottom plan view of the circuit board 150 for the circular electronic switch assembly 100 of this invention.
Figure 4:
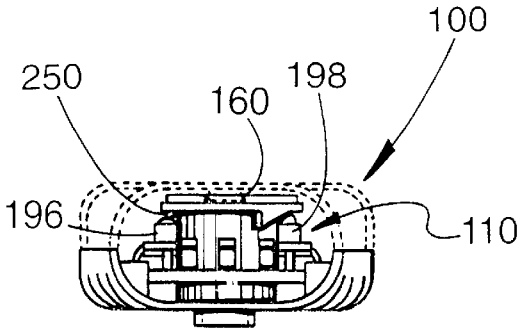
FIG. 4 depicts a front, side view of the electronic switch assembly 100 of this invention with left switch 196 of switch mechanism 110 depressed.
Figure 5:
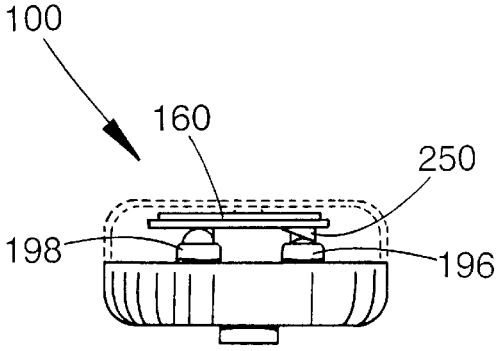
FIG. 5 depicts a back, side view of the circular electronic switch assembly 100 of this invention, based on FIG. 4.
Figure 6:
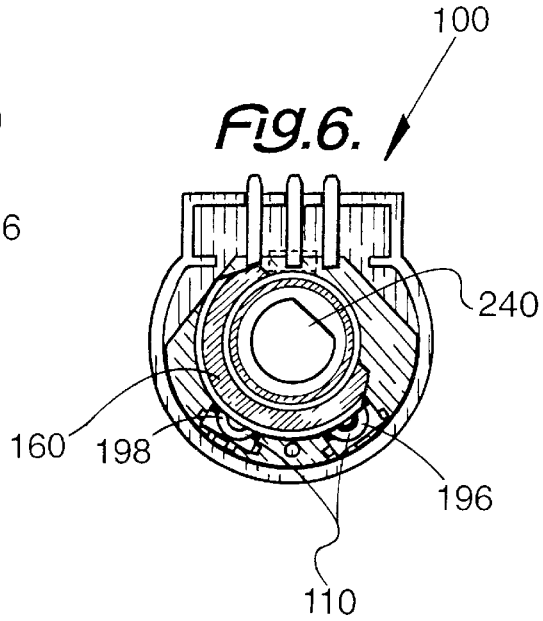
FIG. 6 depicts a top plan view of the circular electronic switch assembly 100 with left switch 196 of switch mechanism 110 depressed, based on FIG. 4.
Figure 7:
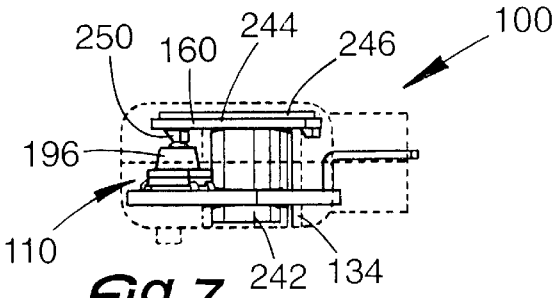
FIG. 7 depicts a left side, profile view of the circular electronic switch assembly 100 with left switch 196 of switch mechanism 110 depressed.

And FIG. 2 and FIG. 3 to the consideration, the structure of switch mechanism 110 includes circuit board 150 having a first or left activating switch 196 and a second or right activating switch 198 mounted thereon. Both left switch 196 and right switch 198 include a switch base 200 having a dimpled contact 202 on one side thereof. On the side of base 200, which is oppositely disposed from dimpled contact 202 and formed into assembled switch 204, are four corner contact prongs 206 connecting both left switch 196 and right switch 198 to the circuit board 150.

Over the dimpled contact 202 is placed a base insulator 208. On the base insulator 208 is placed a rubber tube spring 210. Over the rubber tube spring 210 is a button 212. Over the button 212 is placed a button housing 214, which completes the formation of either the left switch 196 or the right switch 198.

From a bottom view, circuit board 150 has a left circuit 220 and a right circuit 222. Left circuit 220 leads to left prong 224, while right circuit 222 leads to right prong 226. Line connector 230 is set therebetween and provides connection and activation of the circuit board 150 and, hence the switch assembly 110.

With FIG. 4, FIG. 5, FIG. 6, and FIG. 7, added to the consideration, the operation of activating rotor 160 on left switch 196 may be seen. Activating rotor 160 swings or rotates back and forth like a pendulum. Activating rotor 160 includes a rotor aperture 240 with a rotor cylinder 242 extending through circuit board 150 and into cylinder mount 144. Activating rotor 160 has a rotor platform 244 extending therefrom and oppositely disposed from rotor cylinder 242. At the edge of rotor platform 244 is a platform flange 246 extending therefrom in an oppositely disposed fashion relative to the rotor cylinder 242.

Additionally considering FIG. 8, FIG. 9, FIG. 10, and FIG. 11, the function of switch assembly can be considered.

Below activating rotor platform 244 and oppositely disposed from platform flange 246 is left rotor cam 250 and right rotor cam 252. As activating rotor 160 reciprocates, left rotor cam 250 can operate left switch 196, and right rotor cam 252 can operate right switch 198.

Furthermore, rotor 160 has a rotor keyway 260 in the form of a flattened side on a chord of rotor cylinder 242. Rotor 160 also has a bearing track 262 to receive bearing slot 128 in cover 124. Cover 124 furthermore includes a cover stop 264, which limits rotation of the rotor 160, thereby permitting activation of the left switch 196 or the right switch 198 in alternate fashions.

On rotor platform 244 is right rotor stop catch 270 and left rotor stop catch 272, which cooperate with cover stop 264. In this fashion, rotor 160 cannot rotate 360 degrees.

Such movement between left switch 196 and right switch 198 moves the desired item, such as a power window, in the desired direction. For example, left switch 196 and right switch 198 can move a window up or down depending how each is wired. The cooperation between left switch 196 and right switch 198 with different operating function efficiently raises or lowers the window as desired.

Figure 12:
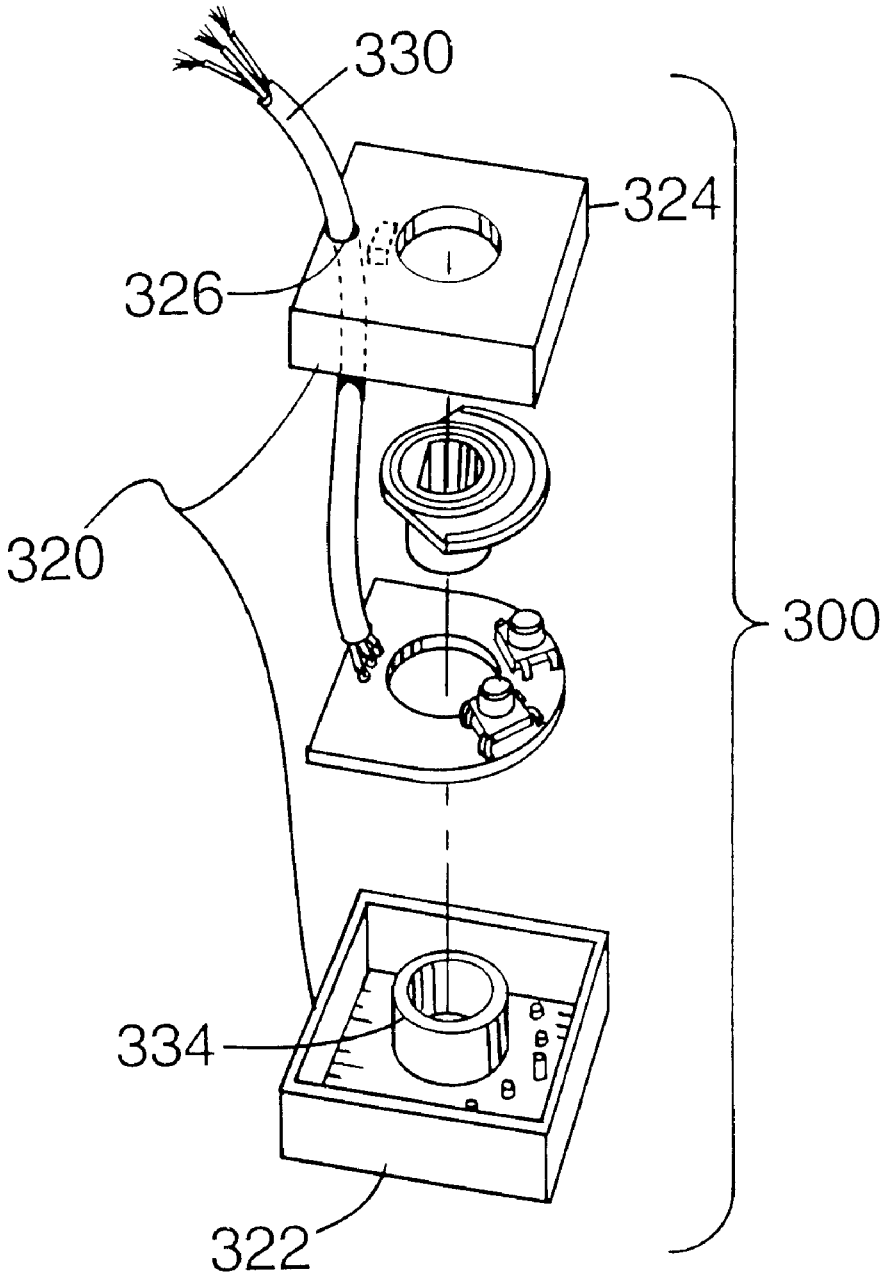
FIG. 12 depicts an exploded perspective view of the rectangular electronic switch assembly 300 of this invention.

Referring now to FIG. 12, rectangular electronic switch assembly 300 has a rectangular housing 320, which in turn, has a rectangular body 322 and a rectangular cover 324 for the rectangular body 322. Attached to or contained within rectangular housing 320 are the elements of the electronic switch assembly 100. At the base of the rectangular body 322 is a rectangular switch mount 308 similar to that shown in FIG. 8 for circular switch mount 108.

Rectangular housing 320 has a generally rectangular appearance, with a wire aperture 326 in rectangular cover 324. Three conductor wire 330 replaces left prong 224, right prong 226 and line connector 230. Wire aperture 326 permits three conductor wire 330 to access or be connected whatever device may be operated or controlled by rectangular electronic switch assembly 300.

More particularly, rectangular body 322 has a second circuit receiver 334 similar in purpose and function to circuit receiver 134 of FIG. 1. Cradle 132 of FIG. 1 is not required in view of wire aperture 326. Second circuit receiver 334 functions as circuit receiver 134.

Clearly the various structures of rectangular electronic switch assembly 300 and circular electronic switch assembly 100 are possible. For example, wire aperture 326, with its associated structure may be used in circular electronic switch assembly 100. Likewise, connector tunnel 166 with its associated structure of FIG. 1 may replace wire aperture 326 and corresponding features in FIG. 12.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An electronic switch assembly comprising:

(a) a switch mechanism and a rotor within a housing forming the electronic switch assembly;

(b) at least one switch being part of the switch mechanism;

(c) the at least one switch being capable of receiving a contact from a rotor, in order to control at least one power accessory;

(d) the electronic switch assembly operating at least one power accessory;

(e) the housing including a body and a cover;

(f) the body and the cover forming the housing;

(g) the body supporting the switch mechanism;

(h) the cover having a positioning means for the rotor;

(i) the positioning means including a ridge in the cover; and (j) the rotor including a groove to receive the ridge in the cover.

2. The electronic switch assembly of claim 1 further comprising:

(a) the rotor being reciprocally movable within the housing;

(b) the switch mechanism having the at least one activating switch thereon; and (c) the rotor including at least one cam for releasably contacting the at least one activating switch.

3. The electronic switch assembly of claim 2 further comprising:

(a) the switch mechanism having a connecting means extending therefrom;

(b) the housing having an interior structure in order to provide for a movement of the rotor;

(c) the housing having an exterior structure supporting the interior structure;

(d) a passage means for the housing permitting the switch mechanism to be connected in an electrical circuit;

(e) the passage means receiving the connecting means;

(f) the connecting means being at least one selected from the group consisting of a solid connector, a rigid connector, a semi-rigid connector or a flexible connector; and (g) a fastener securing the connecting means in the housing and the electrical circuit.

4. The electronic switch assembly of claim 3 further comprising:

(a) the connecting means being three prongs;

(b) a lower connector cradle extending from the body;

(c) an upper connector cradle extending from the cover;

(d) the lower connector and the upper connector cradle combining to protect the three prongs; and (e) the three prongs providing a connection to the at least one power accessory.

5. An electronic switch assembly comprising:

a switch mechanism and a rotor within a housing forming the electronic switch assembly;

at least one activating switch being part of the switch mechanism;

the at least one activating switch being capable of receiving a contact from a rotor, in order to control at least one power accessory on a vehicle;

the electronic switch assembly for operating the at least one power accessory on the vehicle;

the rotor having a reciprocating movement;

the housing containing the switch mechanism;

the switch mechanism having a connecting means in order to connect the electronic switch assembly to the at least one power accessory;

the housing supporting the switch mechanism and the rotor in an operating relationship;

the housing including a body and a cover;

the body and the cover forming the housing;

the body supporting the switch mechanism;

the cover positioning the rotor;

the rotor being reciprocally movable within the housing;

the switch mechanism having at least one activating switch thereon;

the rotor including at least one cam for releasably contacting the at least one activating switch;

the switch mechanism having a connecting means extending therefrom;

the housing having an interior structure in order to provide for a movement of the rotor;

the housing having an exterior structure of a suitable shape;

a passage means for the housing permitting the switch mechanism to be connected in an electrical circuit;

the passage means receiving the connecting means;

a fastener securing the connecting means in the housing and the electrical circuit;

the connecting means being three prongs;

a lower connector cradle extending from the body;

an upper connector cradle extending from the cover;

the lower connector cradle and the upper connector cradle combining to protect the three prongs; and the three prongs providing a connection to the at least one power accessory.

6. The electronic switch assembly of claim 5 further comprising:

(a) the switch mechanism including a circuit board;

(b) the three prongs extending from the circuit board;

(c) the circuit board having the at least one activating switch thereon; and (d) the at least one cam releasably contacting the at least one activating switch.

7. The electronic switch assembly of claim 6 further comprising:

(a) the at least one cam being a first cam and a second cam; and (b) the at least one activating switch being a first activating switch and a second activating switch; and (c) the first cam contacting the first activating switch and the second cam contacting the second activating switch.

8. An electronic switch assembly comprising:

a switch mechanism and a rotor within a housing forming the electronic switch assembly;

at least one switch being part of the switch mechanism;

the at least one switch being capable of receiving a contact from a rotor, in order to control at least one power accessory on a vehicle;

the electronic switch assembly operating the at least one power accessory on the vehicle;

the rotor having a reciprocating movement;

the housing containing the switch mechanism;

the switch mechanism having a connecting means in order to connect the electronic switch assembly to the at least one power accessory;

the housing supporting the switch mechanism and the rotor in an operating relationship;

the housing including a body and a cover;

the body and the cover forming the housing;

the body supporting the switch mechanism;

the cover positioning the rotor;

the rotor being reciprocally movable within the housing;

the switch mechanism having the at least one activating switch thereon;

the rotor including at least one cam for releasably contacting the at least one activating switch;

the switch mechanism having the connecting means extending therefrom;

the housing having an interior structure in order to provide for a movement of the rotor;

the housing having an exterior structure of a suitable shape;

a passage means for the housing permitting the switch mechanism to be connected in an electrical circuit;

the passage means receiving the connecting means;

the connecting means being at least one selected from the group consisting of a solid connector, a rigid connector, a semi-rigid connector or a flexible connector;

a fastener securing the connecting means in the housing and the electrical circuit;

the connecting means being three prongs;

a lower connector cradle extending from the body;

an upper connector cradle extending from the cover;

a plug shield being situated between the upper connector cradle and the lower connecting cradle;

the plug shield serving as a guide for connecting the switch assembly; and the plug shield further including a locking latch thereon, in order to provide additional support to the switch assembly.

9. An electronic switch assembly comprising:

a switch mechanism and a rotor within a housing forming the electronic switch assembly;

at least one activating switch being part of the switch mechanism;

the at least one activating switch being capable of receiving a contact from a rotor, in order to control at least one power accessory;

the electronic switch assembly operating at least one power accessory;

the housing including a body and a cover;

the body and the cover forming the housing;

the body supporting the switch mechanism;

the cover having a positioning means for the rotor;

the positioning means including a ridge in the cover;

the rotor including a groove to receive the ridge in the cover;

the rotor being reciprocally movable within the housing;

the switch mechanism having the at least one activating switch thereon;

the rotor including at least one cam for releasably contacting the at least one activating switch;

the switch mechanism having a connecting means extending therefrom;

the housing having an interior structure in order to provide for a movement of the rotor;

the housing having an exterior structure of a suitable shape;

a passage means for the housing permitting the switch mechanism to be connected in an electrical circuit;

the passage means receiving the connecting means;

a fastener securing the connecting means in the housing and the electrical circuit;

the connecting means being three prongs;

a lower connector cradle extending from the body;

an upper connector cradle extending from the cover;

the lower connector and the upper connector cradle combining to protect the three prongs; and the three prongs providing a connection to the at least one power accessory.

10. An electronic switch assembly comprising:

a switch mechanism and a rotor within a housing forming the electronic switch assembly;

at least one activating switch being part of the switch mechanism;

the at least one activating switch being capable of receiving a contact from a rotor, in order to control at least one power accessory on a vehicle;

the electronic switch assembly operating the at least one power accessory on the vehicle;

the rotor having a reciprocating movement;

the housing containing the switch mechanism;

the switch mechanism having a connecting means in order to connect the electronic switch assembly to the at least one power accessory;

the housing supporting the switch mechanism and the rotor in an operating relationship;

the housing including a body and a cover;

the body and the cover forming the housing;

the body supporting the switch mechanism;

the cover positioning the rotor;

the rotor being reciprocally movable within the housing;

the switch mechanism having the at least one activating switch thereon;

the rotor including at least one cam for releasably contacting the at least one activating switch;

the switch mechanism having the connecting means extending therefrom;

the housing having an interior structure in order to provide for a movement of the rotor;

the housing having an exterior structure supporting the interior structure;

a passage means for the housing permitting the switch mechanism to be connected in an electrical circuit; and the passage means receiving the connecting means.

11. The electronic switch assembly of claim 10 further comprising:

(a) the connecting means being at least one selected from the group consisting of a solid connector, a rigid connector, a semi-rigid connector or a flexible connector; and (b) a fastener securing the connecting means in the housing and the electrical circuit.

12. The electronic switch assembly of claim 11 further comprising:

(a) the connecting means being three prongs;

(b) a lower connector cradle extending from the body;

(c) an upper connector cradle extending from the cover;

(d) the lower connector cradle and the upper connector cradle combining to protect the three prongs; and (e) the three prongs providing a connection to the at least one power accessory.

13. The electronic switch assembly of claim 11 further comprising:

(a) the switch mechanism including a circuit board;

(b) the connecting means being three wires; and (c) the three wires being connected at one end to the circuit board and at an opposing end to the electrical circuit.

14. The electronic switch assembly of claim 13 further comprising:

(a) the three wires extending from the circuit board;

(b) the circuit board having at least one activating switch thereon; and (c) the at least one cam releasably contacting the at least one activating switch.

15. The electronic switch assembly of claim 14 further comprising:

(a) the at least one cam being a first cam and a second cam; and (b) the at least one activating switch being a first activating switch and a second activating switch;

(c) the first cam contacting the first activating switch and the second cam contacting the second activating switch; and (d) the housing including a wire aperture to receive the three wires, in order to provide for connection to the electrical circuit.

16. The electronic switch assembly of claim 11 further comprising:

(a) the connecting means being three prongs;

(b) a lower connector cradle extending from the body;

(c) an upper connector cradle extending from the cover;

(d) a plug shield being situated between the upper connector cradle and the lower connecting cradle;

(e) the plug shield serving as a guide for connecting the switch assembly; and (f) the plug shield further including a locking latch thereon, in order to provide additional support to the switch assembly.

17. The electronic switch assembly of claim 11 further comprising:

(a) the switch mechanism including a circuit board;

(b) at least two mounting pins being situated in the body;

(c) the at least two mounting pins supporting the circuit board in the body;

(d) a cylinder mount substantially centrally located in the body;

(e) the circuit board having a central aperture;

(f) a plug shield being in a snap fit relation between an upper connector cradle and a lower connecting cradle;

(g) the cylinder mount receiving the circuit board in a male to female relationship; and (h) the cylinder mount receiving the rotor in a female to male relationship.

18. The electronic switch assembly of claim 17 further comprising:

(a) the cover being similar in shape to the body;

(b) a plug shield being formed by the lower connector cradle and the upper connector cradle extending from the cover;

(c) the plug shield including a pair of wing grips;

(d) the pair of wing grips cooperating with a pair of holding lips in order to secure the plug shield within housing in a snap fit fashion;

(e) the plug shield including a pair of prong apertures positioned adjacent to the pair of wing grips; and (f) the plug shield securing the electronic switch assembly at a desired position, within the electrical circuit in order to operate the at least one power accessory on the vehicle.

19. The electronic switch assembly of claim 18 further comprising:

(a) the at least one activating switch being a first activating switch and a second activating switch;

b) the first switch and the second switch being tactile switches; and (c) the first switch and the second switch each having a base insulator with a rubber tube spring having a button mounted thereover with a button housing mounted over the button.

* * * * *